US006045879A

United States Patent [19]

Lisiten et al.

[11] Patent Number: 6,045,879

[45] Date of Patent: Apr. 4, 2000

[54] ILLUMINATABLE DECORATIVE OBJECT AND METHOD FOR MAKING SAME

[75] Inventors: Darren Lisiten, Merrick, N.Y.; Geoffrey McCabe, Seattle, Wash.

[73] Assignee: Seventh Sense, Inc., Merrick, N.Y.

[21] Appl. No.: 09/057,751

[22] Filed: Apr. 9, 1998

[51] Int. Cl.[7] ..... A47G 33/04

[52] U.S. Cl. ..... 428/7; 428/11; 428/195; 362/457; 362/806; 427/222

[58] Field of Search ..... 428/7, 11, 195; 362/147, 226, 222, 457, 806; 427/222

[56] References Cited

U.S. PATENT DOCUMENTS

| | | | |
|---|---|---|---|
| D. 155,460 | 10/1949 | Sundheim, Jr. | D26/4 |
| D. 215,304 | 9/1969 | Kadmon | D26/25 |
| 2,095,648 | 11/1937 | Oftedahl | 428/11 X |
| 2,231,481 | 2/1941 | Rogers et al. | 156/89.24 |
| 2,532,023 | 11/1950 | Guth, Jr. | 362/255 |
| 2,749,432 | 6/1956 | Dorsey | 267/261 |
| 3,035,162 | 5/1962 | Emmich | 428/11 X |
| 3,673,402 | 6/1972 | Weiss | 362/220 |
| 3,849,640 | 11/1974 | McCarthy | 362/437 |
| 3,853,797 | 12/1974 | Pelzig | 524/48 |
| 4,110,499 | 8/1978 | Harrison | 428/34.7 |
| 4,224,364 | 9/1980 | Hunt | 428/11 |
| 4,299,632 | 11/1981 | Gosin | 501/127 |
| 4,331,773 | 5/1982 | Hongo et al. | 501/128 |
| 4,413,311 | 11/1983 | Orenstein | 362/219 |
| 4,447,548 | 5/1984 | Huebsch, III | 501/85 |
| 4,833,580 | 5/1989 | Allen | 428/11 X |
| 4,956,404 | 9/1990 | Pelzig | 428/542.2 X |
| 4,991,070 | 2/1991 | Stob | 362/223 |
| 5,008,787 | 4/1991 | Sklar et al. | 362/221 |
| 5,040,104 | 8/1991 | Huisingh et al. | 362/330 |
| 5,116,174 | 5/1992 | Fried et al. | 409/79 |
| 5,135,568 | 8/1992 | Fasano | 428/402 X |
| 5,142,466 | 8/1992 | Foster et al. | 362/368 |
| 5,197,797 | 3/1993 | Jaksich | 362/219 |
| 5,361,192 | 11/1994 | Lai | 362/123 |
| 5,453,917 | 9/1995 | Ogawa | 362/222 |
| 5,537,315 | 7/1996 | Witte | 428/7 |
| 5,541,823 | 7/1996 | Fallon et al. | 362/219 |
| 5,550,724 | 8/1996 | Moulton | 362/267 |
| 5,801,216 | 9/1998 | Pinnavaia et al. | 523/209 |

OTHER PUBLICATIONS

*The New Clay, Techniques and Approaches to Jewelry Making* by Nan Roche, Flower Valley Press, copyright 1991.

*Primary Examiner*—Deborah Jones
*Assistant Examiner*—Abraham Bahta

[57] ABSTRACT

An illuminatable decorative object made of a base of an optical material covered on at least one side with a layer of a malleable material displaying an image thereon. The invention also relates to a method of making an illuminatable decorative object by arranging a malleable material into an image bearing disk in which the image extends through the width of the disk; rolling the image bearing disk into a cane; cutting the cane into a second disk; and molding the second disk onto the surface of an optical material.

19 Claims, 2 Drawing Sheets

ILLUMINATABLE DECORATIVE OBJECT AND METHOD FOR MAKING SAME

TECHNICAL FIELD

The present invention relates generally to an illuminatable decorative object, and more particularly to a decorative object having a base made of an optical material covered on at least one side with a layer of malleable material displaying an image thereon. Furthermore, the present invention relates to a method of making the illuminatable decorative object by rolling an image bearing disk, wherein the image extends throughout the thickness of the disk, into a cane, slicing the cane into a plurality of approximately equal sized second disks, and applying a second disk to the optical material.

BACKGROUND OF THE PRESENT INVENTION

In the past, efforts have been made to decorate bulbs with paint or the like. Such bulbs have been used with a certain degree of success, especially where the bulbs have a low wattage. However at high temperatures the paint is destroyed, and where different colors of paint overlap the transparency of the paint is adversely affected.

Alternatively, vitreous enamels may be applied to the bulb in a manner suggested by U.S. Pat. No. 2,231,481 to Rogers et al. ("Rogers"). Rogers uses a solution of vitreous enamel in an organic solution to apply the enamel to a bulb and then bakes the bulb. Although this method creates images that may withstand high temperatures, the images generated on the bulb are of limited quality since the complexity of the image is limited. Also, the vitreous enamel may run, further complicating attempts to generate complex images.

U.S. Pat. No. 4,833,580 to Allen describes an illuminated decorative ornament. The ornament consists of a hollow translucent shell with an image painted or printed thereon. The image may be further embellished with synthetic hair and other items. The image on these ornaments deteriorates as the embellishments become unglued and the paint becomes chipped.

The above methods of decorating bulbs or other illuminated object all suffer from the hazards created when the bulbs or objects break or shatter.

Thus, a need exists for creating complex, long lasting images on light bulbs or illuminated objects. Also, a need exists for a coating on the bulbs that reduces the hazard created when the underlying bulb breaks or shatters.

SUMMARY OF THE INVENTION

The present invention relates to an illuminatable decorative object having a base made of an optical material covered on at least one side with a layer of malleable material having an image. In one embodiment, the illuminatable decorative object has one or more holes. Additionally, the illuminatable decorative object may have an attachment member. In a preferred embodiment, a fixture is attached to the illuminatable decorative object. More preferably, the fixture has a light source or an attachment member. In yet another embodiment, the illuminatable decorative object is within a frame. In addition, the illuminatable decorative object of the present invention may be attached to a smoke detector, which is a particularly useful feature in view of the naturally hazardous nature of light sources.

In a further embodiment, the malleable decorative layer is made of an elastic material. Preferably, the malleable material comprises an emulsion of a polyvinyl acetate homopolymer. More preferably, the malleable material is a polymer clay, such as FIMO™ clay. Moreover, the malleable material may contain various additives.

The invention also relates to a method of making an illuminatable object by arranging a malleable material into an image bearing disk in which the image extends through the thickness of the disk; rolling the image bearing disk into a cane; cutting the cane into a second disk; and molding the second disk onto an optical material. In one embodiment, the method includes the step of baking the illuminatable decorative object after the second disk has been molded onto the optical material. In a further embodiment, the method also has the step of attaching a fixture and/or smoke detector to the illuminatable decorative object. Preferably, the fixture incorporates a light source. The method may also consist of drilling a hole into the illuminatable decorative object. In another embodiment, the method includes the step of placing the illuminatable decorative object in a frame. In yet another embodiment, an attachment member is connected to the illuminatable decorative object.

BRIEF DESCRIPTION OF THE DRAWINGS

Reference is next made to a brief description of the drawings, which are intended to illustrate the illuminatable decorative object and method of making the same. The drawings and detailed descriptions which follow are intended to be merely illustrative and are not intended to limit the scope of the invention as set forth in the appended claims.

FIG. 1*a* is a side view of an image bearing disk made of a malleable elastic material;

FIG. 1*b* is a side view of a cane made by rolling the image bearing disk;

FIG. 1*c* is a side view of the cane cut into individual disks; and

FIG. 1*d* is a side view of the disk being applied to the optical material.

DETAILED DESCRIPTION OF THE PREFERRED EMBODIMENTS

The present invention relates to an illuminatable decorative object having a base made of an optical material coated on at least one side with a malleable material bearing an image or design.

The base of the illuminatable decorative object is made of an optical material. Optical materials consist of all substances used to transmit, refract, filter, polarize, modulate or disperse forms of visible light. Commonly known optical materials are glass and plastic used for windows and lenses. The optical material may be transparent or translucent, and may further be modified so as to change its ability to transmit light. This may be accomplished by coloring the optical material, changing the degree of transparency, modifying the uniformity of the material, or adjusting the refractive index of the material. These optical materials may be of any shape or form, two- or three-dimensional. Thus, the optical material may have a functional form such as a light bulb, lamp shade, candle holder, window pane, etc. Alternatively, the optical material may be cut into various shapes to be used as window decorations, Christmas ornaments, Christmas lights, jewelry, etc. Essentially, the optical material may be fashioned into any form, so long as the form does not substantially impair the material's ability to transmit light.

The malleable material is made of elastic material that transmits light such as a plastic polymer clay as sold by the Eberhard Faber Company of Germany as FIMO™; a polyvinyl chloride material such as PROMATE™; a polyvinyl acetate homopolymer emulsion according to U.S. Pat. No. 4,956,404 to Pelzig, which is incorporated herein by reference; or other polymer clays such as SCULPEY™, manufactured by Polyform Products Company; CERNIT™ made by T+F GmbH Company; and MODELLO™ made by the Reiser Corporation; and derivatives and combinations thereof. Additionally, additives, including but not limited to lustre colors, glitter, sequins, stones, and similar jewelry and decorative substances may be added to the malleable material to enhance the material or the image displayed on the material. Other additives include scents, fragrances, and microspheres as well as those additives disclosed in U.S. Pat. No. 4,956,404 to Pelzig. Preferably, the additives are heat resistant and can withstand the heat required to bake the malleable material and generated by any light source with which the illuminatable decorative object may be used. Furthermore, these additives, as well as other additives known to those skilled in the art, may be present in any amount necessary to achieve the desired results, but not to the extent that the additive substantially interferes with transmission of light through the material.

Figure 1A:
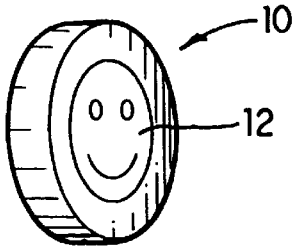
FIGS. 1*a*–1*d* illustrate the individual steps in the method of making an illuminatable decorative object of the present invention. Specifically.

These illuminatable decorative objects are made using the following procedure. First, referring to FIG. 1*a*, an image bearing disk 10 is created. Various images 12 are fabricated on the disk 10 utilizing materials and methods that permit the same image 12 to be displayed on both faces of the disk 10. Techniques known for fabricating such images 12 include the Milifiore Technique, which combines different colored clays to form designs which appear on both faces of the disk 10. Any technique may be used so long as the image 12 extends through the entire thickness of the disk 10. Preferably, the image 12 is created in a manner similar to a pointillist painting wherein each portion of the material represents one spot or point of paint in the overall image 12.

Figure 1B:
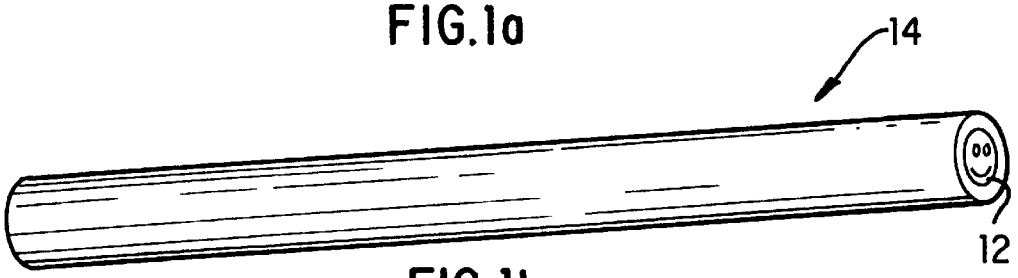
Figure 1C:
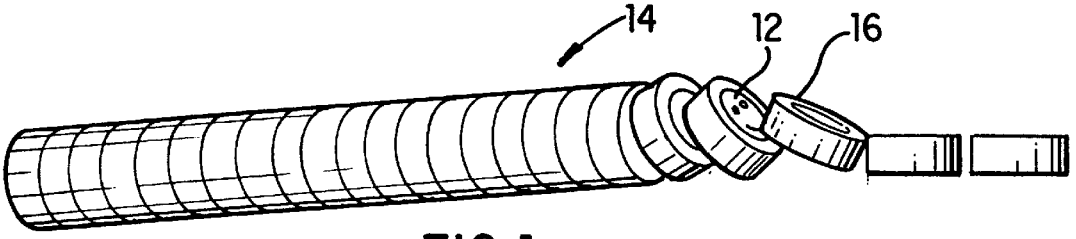

Next, as shown in FIG. 1*b*, the disk 10 is set on its outer circumference and rolled out into a cane 14. Referring to FIG. 1*c*, the cane 14 is subsequently cut into several disks each being referred to as a second disk 16. Although the second disk 16 may be of any thickness desired, preferably the thickness of the second disk 16 permits the material to transmit light. The appearance of the second disk 16 may be modified in any manner known to those skilled in the art so long as it does not substantially affect the malleable material's ability to transmit light. Thus, the appearance of the second disk 16 may be modified by modifying the shape of the disk, by further molding the disk, trimming or cutting away the edges of the disk, using a cutter or die to provide a uniform shape to the disk, or in any other manner known to those skilled in the art. Also, the appearance of the second disk 16 may be modified by rounding the edges of the disk, flattening or otherwise altering the thickness of the disk, using an embossing die or molding the disk in relief, and any other method known to those skilled in the art. The second disk 16 may be modified at this stage of the process or at any other time prior to baking the malleable material.

Figure 1D:
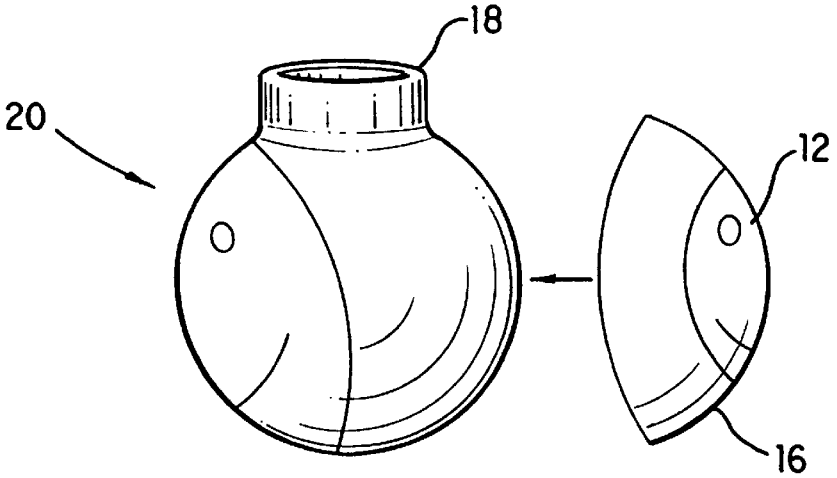

Referring to FIG. 1*d*, the second disk 16 is then applied to at least one side of the optical material 18. Depending upon the size of the optical material 18, one or more of the second disks 16 may be used to cover the surface of the optical material 18. Furthermore, once the second disk 16 has been applied to the surface of the optical material 18, the malleable material may be stretched or manipulated to cover the entire surface of the optical material 18 provided that the quality of the image 12 on the second disk 16 is not diminished. Alternatively, portions of the malleable material may be applied to fill in areas that the second disk 16 cannot cover. Preferably, the malleable material substantially covers the surface of the optical material 18, although uncovered areas of the optical material 18 may be maintained for aesthetic reasons.

Finally, once the second disk 16 has been applied to the optical material 18 it may be allowed to dry in order to become sufficiently hard. Preferably the illuminatable decorative object 20 is baked to harden the malleable material and bond the second disk 16 to the optical material 18. Even after baking the malleable material maintains some elasticity. The now hardened malleable material advantageously maintains the shape of the illuminatable decorative object 20 even if the optical material 18 breaks. This provides a safety benefit when dealing with optical materials 18 such as glass which may shatter or break. By maintaining the shape of the illuminatable decorative object 20 the malleable material eliminates safety concerns created by broken glass.

Figure 2:
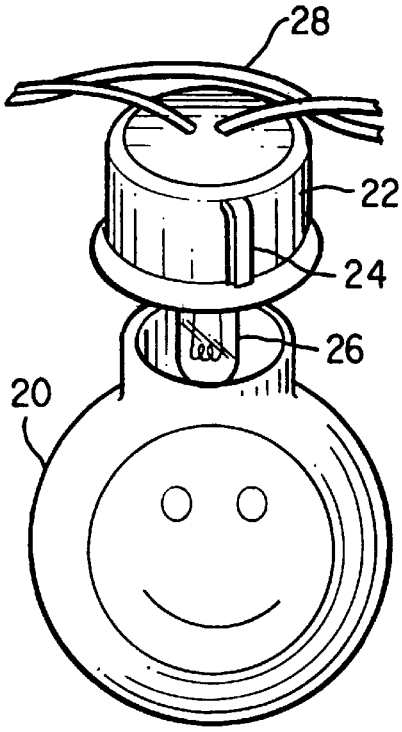
FIG. 2 is a side view of the illuminatable decoration being fitted within a fixture that has a light source.

Following the baking, as illustrated in FIG. 2, the illuminatable decorative object 20 may be optionally attached to a fixture 22, such as a light socket, lamp, candle holder, etc. Preferably, the fixture 22 incorporates a light source 26, such as a light, candle, oil lamp, etc. Additionally, the fixture may have an attachment member 24, including but not limited to hooks, tabs, loops, suction cups, nails, screws, nuts and bolts, adhesive, or clamps. Several of the fixtures 22 may be strung together with connecting electrical wire 28, such as in a string of Christmas lights. When the fixtures 22 are strung together in this manner each fixture 22 may have a different illuminatable decorative object 20 or similar ones.

Figure 3:
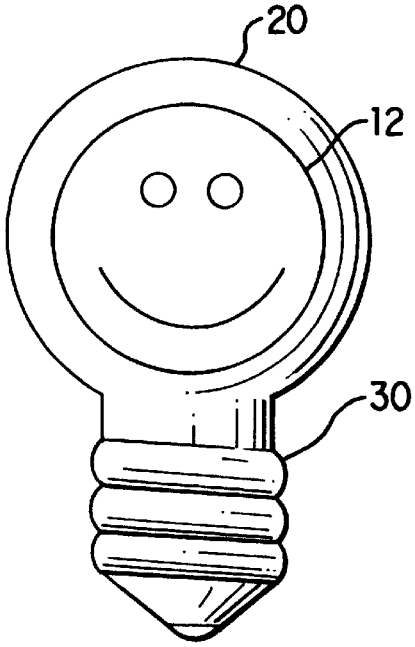
FIG. 3 is a side view of an illuminatable decorative object comprising a light bulb.

Alternatively, the base of the present invention may be a part of a light source 30 as shown in FIG. 3. In this embodiment, the malleable material is applied directly to the light source 30. Thus, as shown in FIG. 3, the second disk may be applied directly to the bulb portion of a light bulb. In either case, it is preferable if the fixture 22 or light source 30 can withstand the heat needed to bake the malleable material.

Figure 4:
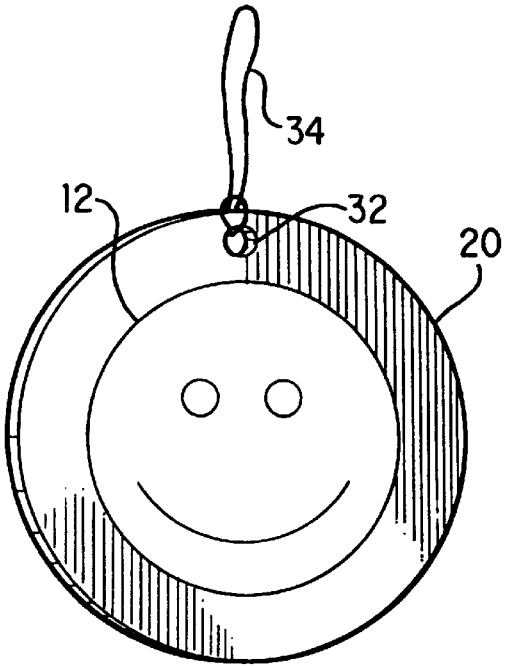
FIG. 4 is a side view of the illuminatable decorative object with a hole and an attachment means.

Furthermore, one or more holes 32 may be drilled in the illuminatable decorative object 20 as shown in FIG. 4. The hole 32 permits several of the illuminatable decorative objects 20 to be strung together to form articles such as wind chimes or mobiles. Also, the hole 32, or other attachment means such as adhesives, may be use to connect an attachment member 34 to the illuminatable decorative object 20.

Figure 5:
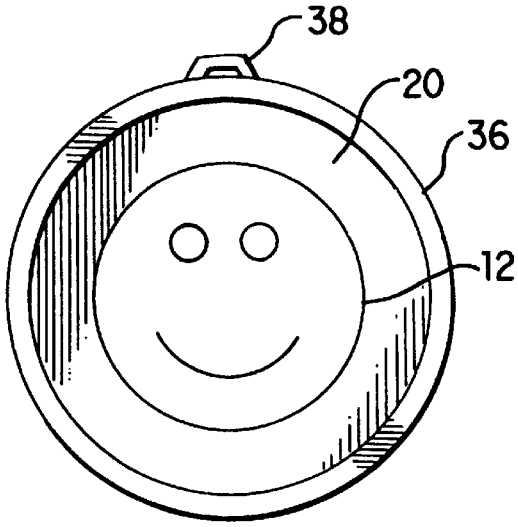
FIG. 5 is a side view of the illuminatable decorative object in a frame.

Additionally, FIG. 5 demonstrates that the illuminatable decorative object 20 may be enclosed in a molding or framing 36. This molding or framing 36 may consist of any material. Preferably the material is wood, plastic, or other inexpensive metals. The molding or framing 36 advantageously hides any rough or unfinished edges on the illuminatable decorative object 20, and also may provide the illuminatable decorative object 20 with an attachment member 38 without having to drill a hole in the illuminated decorative object. The molding or framing 36 may also be used to connect several illuminatable decorative objects 20 together to form various articles such as, candle holders, jewelry boxes, lamp shades, etc. This may also be accomplished through the use of adhesives, soldering or other means known to those skilled in the art.

It will be readily apparent to those skilled in the art that other variations of the decorative disk and method of making the decorative disk exist which fall within the scope of the appended claims.

What is claimed:

1. An illuminatable decorative object comprising a base made of material which is at least optically translucent such that light may pass therethrough; and an image layer affixed to said base, said image layer comprising a translucent, malleable material having a thickness which is sufficiently thin to permit light to pass through said layer, wherein an image is formed in and extends through said layer.

2. The illuminatable decorative object of claim 1, further comprising an attachment member.

3. The illuminatable decorative object of claim 1, further comprising a fixture.

4. The illuminatable decorative object of claim 3, wherein the fixture further comprises a light source.

5. The illuminatable decorative object of claim 3, wherein the fixture further comprises an attachment member.

6. The illuminatable decorative object of claim 1, further comprising a frame.

7. The illuminatable decorative object of claim 1, further comprising a smoke detector.

8. The illuminatable decorative object of claim 1, wherein the image layer comprises an elastic material.

9. The illuminatable decorative object of claim 1, wherein the malleable material comprises an emulsion of a polyvinyl acetate homopolymer.

10. The illuminatable decorative object of claim 1, wherein malleable material comprises a polymer clay.

11. The illuminatable decorative object of claim 1, wherein the malleable material contains additives.

12. A method of making an illuminatable decorative object comprising:

arranging a malleable material into an image bearing disk in which the image extends through the thickness of the disk;

rolling the image bearing disk into a cane;

cutting the cane into at least one second disk having a thickness sufficiently thin to permit light to pass therethrough; and affixing the at least one second disk on a base material which permits passage of light, such that light may pass through the base and at least one disk to illuminate the image disposed within said at least one disk.

13. The method of claim 12, further comprising the step of baking the illuminatable decorative object after the at least one second disk has been affixed on the base material.

14. The method of claim 12, further comprising the step of attaching a fixture to the illuminatable decorative object.

15. The method of claim 14, wherein the fixture incorporates a light source.

16. The method of claim 12, further comprising the step of drilling a hole into the illuminatable decorative object.

17. The method of claim 12, further comprising the step of placing the illuminatable decorative object in a frame.

18. The method of claim 12, further comprising the step of attaching the illuminatable decorative object to a smoke detector.

19. The method of claim 12, further comprising the step of connecting an attachment member to the illuminatable decorative object.

* * * * *